US008109609B2

(12) United States Patent
Shim et al.

(10) Patent No.: US 8,109,609 B2
(45) Date of Patent: Feb. 7, 2012

(54) INK EJECTING DEVICE AND METHOD OF MANUFACTURING THE SAME

(75) Inventors: Dong-Sik Shim, Suwon-si (KR); Yong-Seop Yoon, Seoul (KR); Bang-Weon Lee, Yongin-si (KR); Moon-Chul Lee, Seongnam-si (KR); Yong-Won Jeong, Seoul (KR); Jong-Seok Kim, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 398 days.

(21) Appl. No.: 12/416,954

(22) Filed: Apr. 2, 2009

(65) Prior Publication Data

US 2010/0053272 A1 Mar. 4, 2010

(30) Foreign Application Priority Data

Sep. 3, 2008 (KR) ..... 10-2008-0086801

(51) Int. Cl.
*B41J 2/14* (2006.01)

(52) U.S. Cl. ..... 347/47

(58) Field of Classification Search ..... 347/40–43, 347/47

See application file for complete search history.

(56) References Cited

U.S. PATENT DOCUMENTS

| | | | | |
|---|---|---|---|---|
| 5,317,346 | A | 5/1994 | Garcia | |
| 6,857,727 | B1 * | 2/2005 | Rausch et al. | 347/44 |
| 7,524,610 | B2 * | 4/2009 | Kim et al. | 430/270.1 |
| 7,771,015 | B2 * | 8/2010 | Silverbrook et al. | 347/44 |
| 2006/0214995 | A1 | 9/2006 | Hayakawa et al. | |

FOREIGN PATENT DOCUMENTS

| | | |
|---|---|---|
| JP | 2005-169993 | 6/2005 |
| JP | 2006-264034 | 10/2006 |

OTHER PUBLICATIONS

English Abstract of JP-2005-169993.
English Abstract of JP-2006-264034.
English language translation of JP-2005-169993.
English language translation of JP-2006-264034.

* cited by examiner

*Primary Examiner* — Lamson Nguyen
(74) *Attorney, Agent, or Firm* — Staas & Halsey LLP

(57) ABSTRACT

Disclosed are an ink ejecting device and a method of manufacturing the same. The disclosed ink ejecting device includes an inkjet head including a substrate, which includes an ink feed hole, a plurality of via holes, which are formed in the rear surface of the substrate, and which expose the ink feed holes therethtough, a chamber layer stacked on the substrate, and a nozzle layer stacked on the chamber layer, and includes a base header, which is attached to the inkjet head and includes a plurality of ink supply slots having a corresponding arrangement with respect to the via holes.

9 Claims, 11 Drawing Sheets

INK EJECTING DEVICE AND METHOD OF MANUFACTURING THE SAME

CROSS-REFERENCE TO RELATED PATENT APPLICATION

This application claims the benefit of Korean Patent Application No. 10-2008-0086801, filed on Sep. 3, 2008, in the Korean Intellectual Property Office, the disclosure of which is incorporated herein in its entirety by reference.

TECHNICAL FIELD

The present disclosure generally relates to an ink ejecting device and a method of manufacturing the same.

BACKGROUND OF RELATED ART

An inkjet image forming device forms images in predetermined colors by ejecting fine ink droplets from an inkjet head to a desired location on a printing medium. Generally speaking, inkjet heads may be classified in one of two types according to the mechanism being employed for ejecting ink droplets; a thermal type and a piezoelectric type. A thermal type inkjet head inkjet head produces ink bubbles using a thermal source, and ejects ink droplets as the bubbles expand. A piezoelectric type inkjet head, on the other hand, ejects ink droplets by applying pressure to the ink using deformation of a piezoelectric element.

In a thermal inkjet head inkjet head, when a pulse of electric current flows in a heater, e.g., formed of a resistive heating material, ink adjacent to the heater becomes instantaneously heated to a high temperature, which could be, e.g., approximately 300° C. by the heat produced by the heater, causing the ink to boil, and to produce ink bubbles. As the generated bubble(s) continue to expand and to thereby exert pressure to surrounding ink filled in an ink chamber, the ink close to a nozzle is ejected to the outside of the ink chamber as ink droplets.

The inkjet head may manufactured as a chip, and may have a structure in which a chamber layer and a nozzle layer are sequentially stacked on a substrate. The chamber layer includes a plurality of ink chambers that are to be filled with ink, whereas the nozzle layer includes a plurality of nozzles through which the ink is ejected from the ink chambers. Additionally, an ink feed hole for supplying ink to the ink chambers may be formed through the substrate. In an inkjet head having the above described structure, the ink feed hole formed through the substrate may present a structural weakness in, or, in some instances, deformation of the substrate. In practice, the inkjet head described above may be mounted on a base header, which may also include formed therein ink supply paths corresponding to the ink feed holes. The ink feed holes in the inkjet head substrate and/or the ink supply paths in the base header tend to reduce the mounting or adhesive surface area of the inkjet head and the base header. Misalignments of the ink feed holes and the corresponding ink supply paths may also occur.

SUMMARY OF THE DISCLOSURE

According to one aspect of the various embodiments of the disclosure, there is provided an ink ejecting device including an inkjet head having a substrate. The inkjet head may include an ink feed hole formed in the substrate, a plurality of via holes formed in a rear surface of the substrate, each of the plurality of via holes being connected to the ink feed hole, a chamber layer stacked on the substrate and a nozzle layer stacked on the chamber layer. The ink ejecting device may further include a base header on which the inkjet head is supported, the base header comprising a plurality of ink supply slots arranged to correspond to the plurality of via holes.

The ink base header may include a base plate in which the ink supply slots are formed and a body supporting the base plate thereon, the body including an ink supply path formed therein, the ink supply path being connected to the ink supply slots of the base plate.

The base plate may be attached to the rear surface of the substrate such that each of the plurality of ink supply slots is correspondingly connected to respective associated one of the plurality of via holes.

A portion of the rear surface of the substrate between the via holes may form at least one support beam.

Each of the plurality via holes may be wider than the ink feed hole.

The chamber layer may include one or more ink chambers formed therein for holding ink supplied by the ink feed hole. The nozzle layer may include one or more of nozzles formed therein, through which ink is ejected from the one or more ink chambers.

The ink chambers may be formed along both sides of the ink feed hole. The nozzles may be formed above the ink chambers.

The ink ejecting device may further comprise an insulation layer formed on the substrate, a plurality of heaters and a plurality of electrodes sequentially formed on the insulation layer and a passivation layer formed over, and covering, the heaters and the electrodes.

The ink ejecting device may further comprise an anti-cavitation layer formed on the passivation layer.

According to another aspect, a method of manufacturing an ink ejecting device may include forming a chamber layer having a plurality of ink chambers on a substrate, forming a plurality of via holes in a rear surface of the substrate, the plurality of via holes extending into the substrate at a predetermined depth, forming an ink feed hole in the substrate, the ink feed hole extending in the substrate to connect with each of the via holes and forming a nozzle layer on the chamber layer, the nozzle layer having a plurality of nozzles.

The method may further include attaching a base header to the rear surface of the substrate, the base header comprising a plurality of ink supply slots in corresponding arrangement with the plurality of via holes.

The base header may comprise a base plate in which the ink supply slots are formed and a body supporting the base plate thereon, the body including an ink supply path formed therein, the ink supply path being connected to the ink supply slots of the base plate.

The base plate may be attached to the rear surface of the substrate such that each of the plurality of ink supply slots is correspondingly connected to respective associated one of the plurality of via holes.

Each of the plurality of via holes may have a first width. The ink feed hole may have a second width. The first width may be greater than the second width.

The via holes may be formed by preparing an etching mask, on which a predetermined etching pattern is formed, on the bottom surface of substrate, and etching portions of the substrate exposed through the etching pattern to a predetermined depth.

The ink feed hole may be formed by etching the top surface of the substrate until the via holes are exposed.

The forming of the nozzle layer may include laminating a nozzle material layer formed of a photosensitive dry film on the chamber layer and forming the plurality of nozzles by patterning the nozzle material layer.

According to yet another aspect, an inkjet head may include a substrate having a top surface, bottom surface and a thickness, a chamber layer formed above the top surface of the substrate, an ink feed hole formed in the substrate and a plurality of recesses formed in the bottom surface of the substrate. The chamber layer may include one or more in chambers for receiving ink therein. The ink feed hole may define the ink supply path through which the ink received by one or more in chambers is supplied. Each of the plurality of recesses may define an access opening to the ink feed hole through which ink is to be supplied to the ink feed hole. The ink feed hole may extend in the substrate by a first depth less that the thickness of the substrate. Each of the plurality of recesses may extend from the bottom surface toward the top surface of the substrate by a second depth less than the first depth. At least a portion of the bottom surface of the substrate between two adjacent ones of the plurality of recesses may form a beam-like structure extending across the ink feed hole.

The plurality of recesses may each have a width across the bottom surface of the substrate that is wider the ink feed hole.

The ink feed hole may comprise a plurality of ink feed holes each corresponding to an associated subset of the plurality of recesses. A fist subset of the plurality of recesses associated with a first one of the plurality of ink feed holes may be in a staggered arrangement with respect to a second subset of the plurality of recesses associated with a second one of the plurality of ink feed holes adjacent the first one of the plurality of ink feed holes.

BRIEF DESCRIPTION OF THE DRAWINGS

Various aspects of the present disclosure will become more apparent and more readily appreciated from the following description of the embodiments, taken in conjunction with the accompanying drawings in which.

DETAILED DESCRIPTION OF SEVERAL EMBODIMENTS

Figure 1:
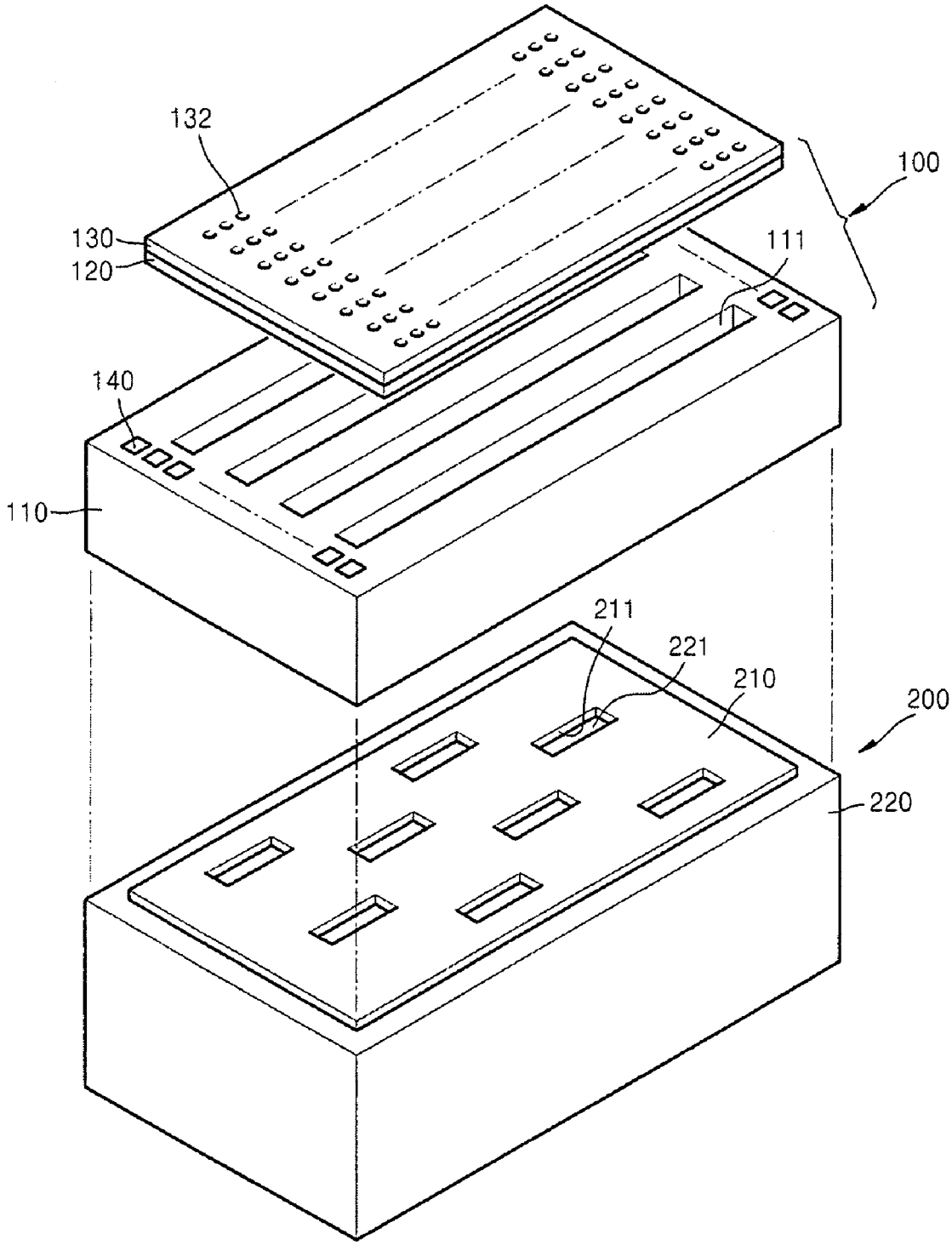
FIG. 1 is an exploded oblique view of an ink ejecting device according to an embodiment of the present disclosure.

Several embodiments will now be described more fully with reference to the accompanying drawings. In the drawings, like reference numerals denote like elements, and the sizes and thicknesses of layers and regions may be exaggerated for clarity. The various embodiments described can have many different forms and should not be construed as being limited to the embodiments specifically set forth herein. It will also be understood that when a layer is referred to as being "on" another layer or substrate, the layer can be disposed directly on the other layer or substrate, or there could be intervening layers between the layer and the other layers or substrate.

Referring to FIG. 1, the ink ejecting device according to an embodiment may include an inkjet head 100 and a base header 200 attached to the inkjet head 100. The inkjet head 100 may have a structure in which a chamber layer 120 and a nozzle layer 130 are sequentially stacked on a substrate 110 in the order stated. A plurality of the inkjet heads 100 may be manufactured contemporaneously as a plurality of chips on a silicon wafer.

Figure 2:
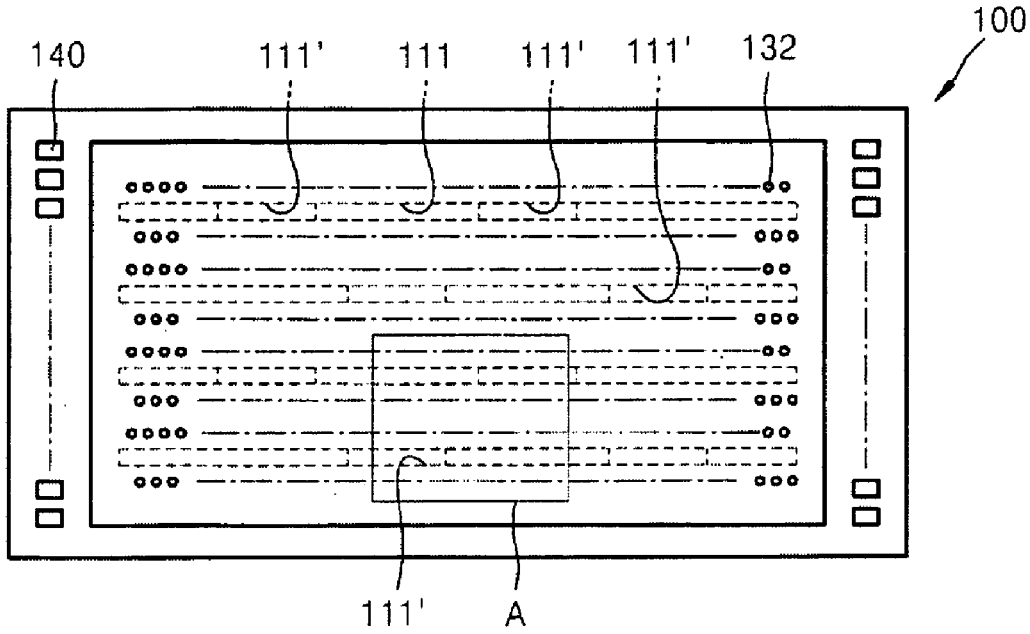
FIG. 2 is a plan view showing an inkjet head shown in FIG. 1.
Figure 3:
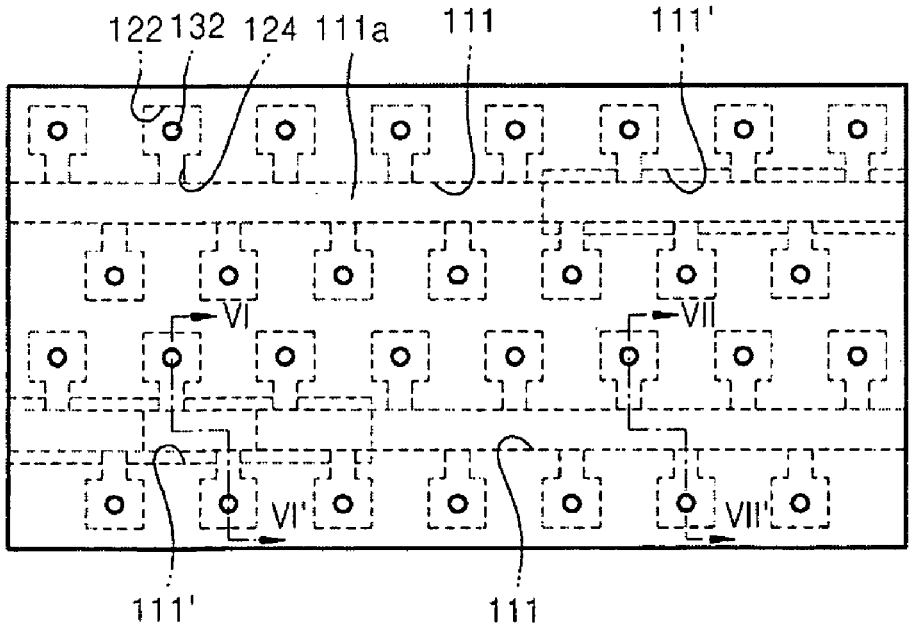
FIG. 3 illustrates the portion A of FIG. 2 in a closer detail.
Figure 4:
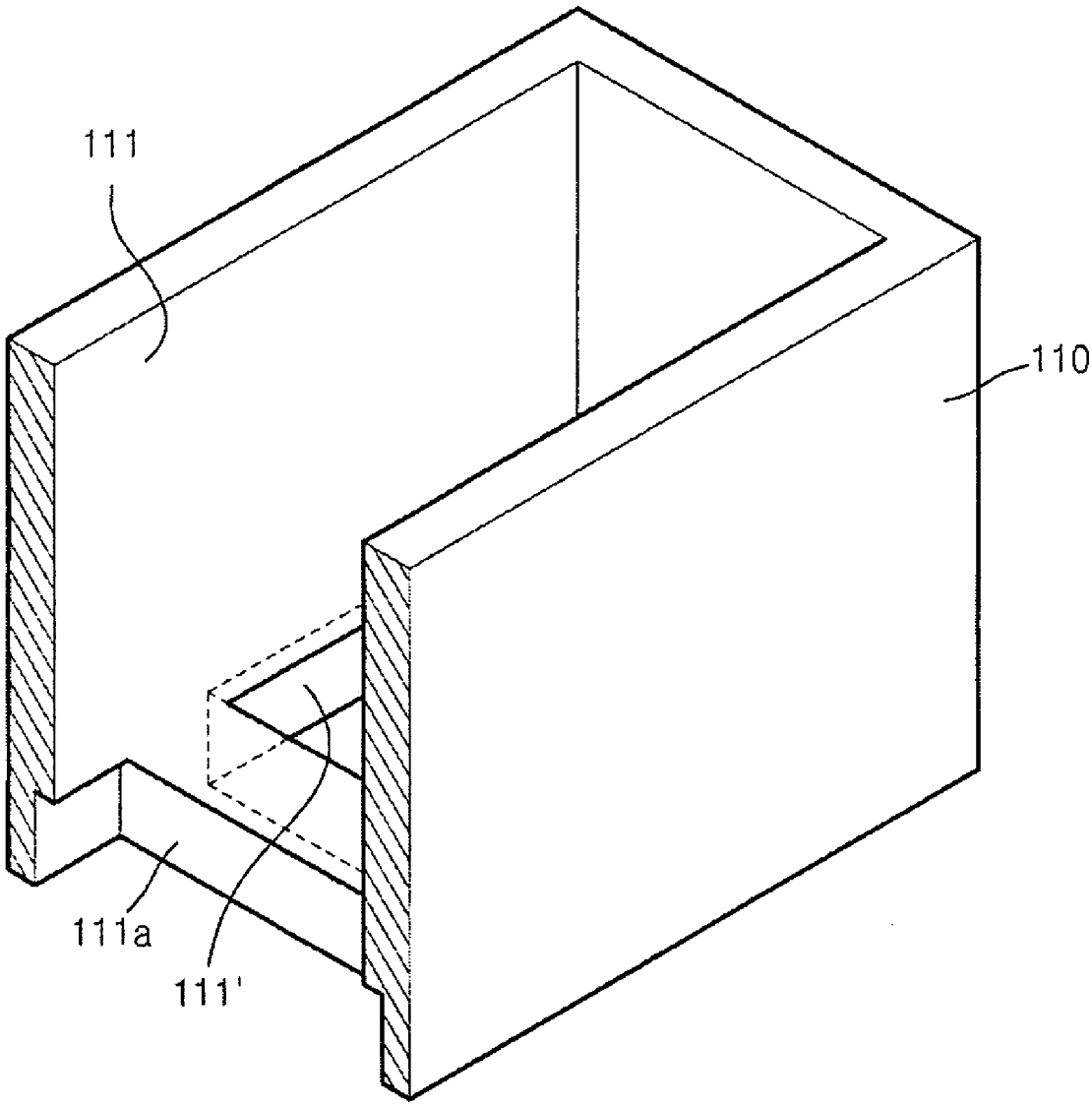
FIG. 4 is an oblique view showing portions of the substrate shown in FIG. 1.
Figure 5:
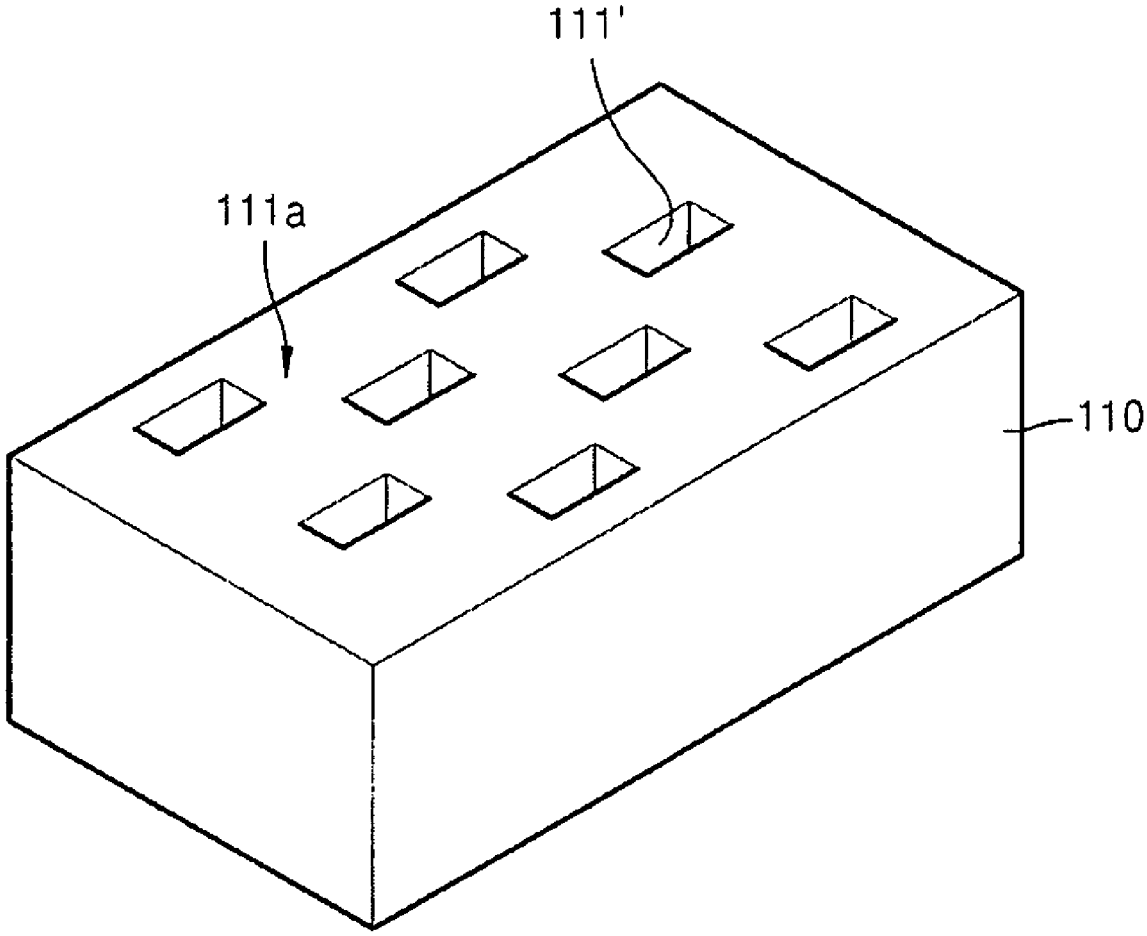
FIG. 5 is a bottom view of the substrate shown in FIG. 1.
Figure 6:
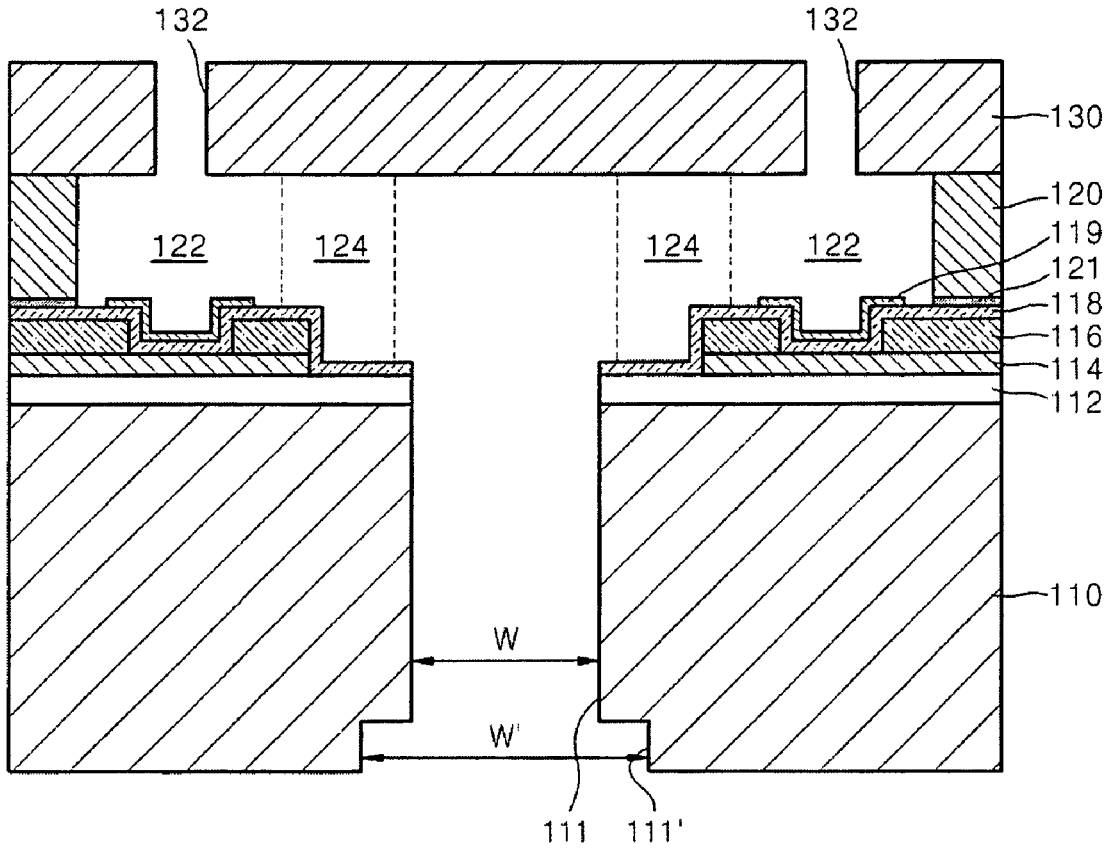
FIG. 6 is a sectional view obtained along the line VI-VI' of FIG. 3.
Figure 7:
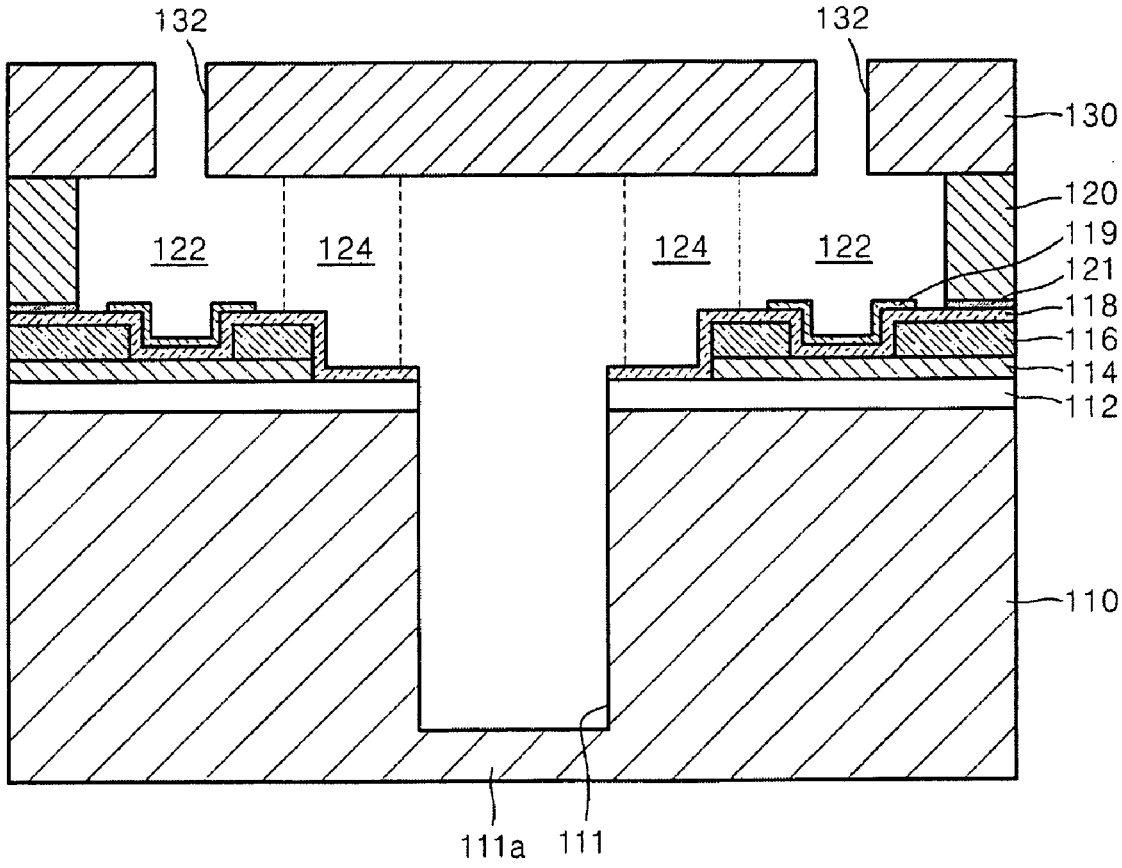
FIG. 7 is a sectional view obtained along the line VII-VII' of FIG. 3.

FIG. 2 is a plan view showing the inkjet head 100 shown in FIG. 1, the portion identified as "A" in FIG. 2 being shown in more detail in FIG. 3. FIG. 4 is an oblique view showing a portion of the substrate 110 of FIG. 1. FIG. 5 is a bottom view of the substrate 110 of FIG. 1. FIGS. 6 and 7 are sectional view obtained respectively along lines VI-VI' and VII-VII' as shown in FIG. 3.

Referring to FIGS. 2 through 7, the chamber layer 120 and the nozzle layer 130 may be sequentially stacked in that order on the substrate 110, on which a plurality of material layers may be stacked. The substrate 110 may be a silicon substrate, for example. An insulation layer 112 may be formed on the substrate 110. The insulation layer 112 may be formed of silicon oxide, for example. A plurality of heaters 114 for heating ink in ink chambers 122, and for generating ink bubbles may be formed on the insulation layer 112. The heaters 114 may be formed of resistive heating material, such as, e.g., tantalum-aluminium alloy, tantalum nitride, titanium nitride, tungsten silicide, or the like. A plurality of electrodes 116 may further be formed on the heaters 114 to apply electric current to the heaters 114. The electrodes 116 may be formed of a material with sufficiently electric conductivity, such as, e.g., aluminium (Al), aluminium alloy, gold (Au), silver (Ag), or the like.

A passivation layer 118 may be formed on the heaters 114 and the electrodes 116 to protect the heaters 114 and the electrodes 116 from being oxidized and/or corroded by ink that may come into contact the heaters 114 and the electrodes 116. The passivation layer 118 may be formed of silicon nitride or silicon oxide, for example. Furthermore, anti-cavitation layers 119 may be formed on the passivation layer 118 to protect the heater 114 from a cavitation force generated when bubbles disappear. The anti-cavitation layer 119 may be formed of tantalum (Ta), for example.

The chamber layer 120 may be disposed on the passivation layer 118. The ink chambers 122 are formed in the chamber layer 120. A plurality of restrictors 124 may further be formed in the chamber layer 120 as paths connecting the ink feed holes 11 and the ink chambers 122. The chamber layer 120 may be formed of a photosensitive polymer, for example. The nozzle layer 130 may be stacked on the chamber layer 120. A plurality of nozzles 132 through which ink is ejected are formed in the nozzle layer 130. The nozzles 132 may be disposed above the ink chambers 122. The nozzle layer 130 may also be formed of a photosensitive polymer, for example. In addition, a glue layer 121 for increasing adhesiveness between the chamber layer 120 and the passivation layer 118 may further be formed on the passivation layer 118. The inkjet head 100 may also include bonding pads 140 for transmitting an electrical printing signal from an inkjet image forming device to each of the electrodes 116.

At least one ink feed hole 111 for supplying ink to the ink chambers 122 is formed in the substrate 110. The ink chambers 122 may be formed along the ink feed hole 111, for example, on both sides of the ink feed hole 111. While, in FIGS. 1 and 2, four ink feed holes 111 are illustrated for respectively supplying different color ink, for example, yellow ink, magenta ink, cyan ink, and black ink, it should be apparent that the number of ink feed holes 111 is not so limited, and that any number ink feed holes 111, including, for example, a single ink feed hole 111 may be formed in the substrate 110.

A plurality of via holes 111' each having a predetermined depth may further be formed in the rear surface of the substrate 110 and below the respective one of the ink feed holes 111, and to be in fluid communication with the respective ink feed holes 111. The ink from the base header 200 (FIG. 1) is supplied to the ink feed holes 111 via the via holes 111'. According to an embodiment, and as illustrated in, e.g., FIG. 6, the width W of each of the via holes 111' may be greater than the width W' of the ink feed holes 111. Thus, ink can be supplied to the ink feed holes 111 via the via holes 111' efficiently. However, other alternative embodiments are also possible where the width W of each of the via holes 111' may be equal to, or even less than, the width W' of the ink feed holes 111. Also, although FIGS. 2 through 5 show an example where two via holes 111' are formed below each of the ink feed holes 111, the present disclosure is so limited. For example, three or more via holes 111' may be formed below each of the ink feed holes 111.

When the via holes 111', connected to the respective ink feed hole 111, are formed at the rear surface of the substrate 110, a portion of the substrate 110 between the via holes 111' may form at least one support beam 111*a*. The support beam 111*a* may provide added mechanical strength for the substrate, and thus may mitigate the possible weakening of the substrate due to the formation of the feed holes 111. Moreover, the support beams 111*a* may also provide additional surface area at the rear surface of the substrate with which the substrate may be adhesively attached to the base header 200.

According to an embodiment, and as shown in FIGS. 2 through 5, a set of via holes 111' corresponding to a predetermined ink feed hole 111 may be arranged in an alternating or staggered arrangement with respect to another set of via hole 111' corresponding to an adjacent ink feed hole 111. The ink supply slots 211 in the base plate 210 of the base header 200 may be configured to have the corresponding arrangement with the via holes 111'.

Figure 8:
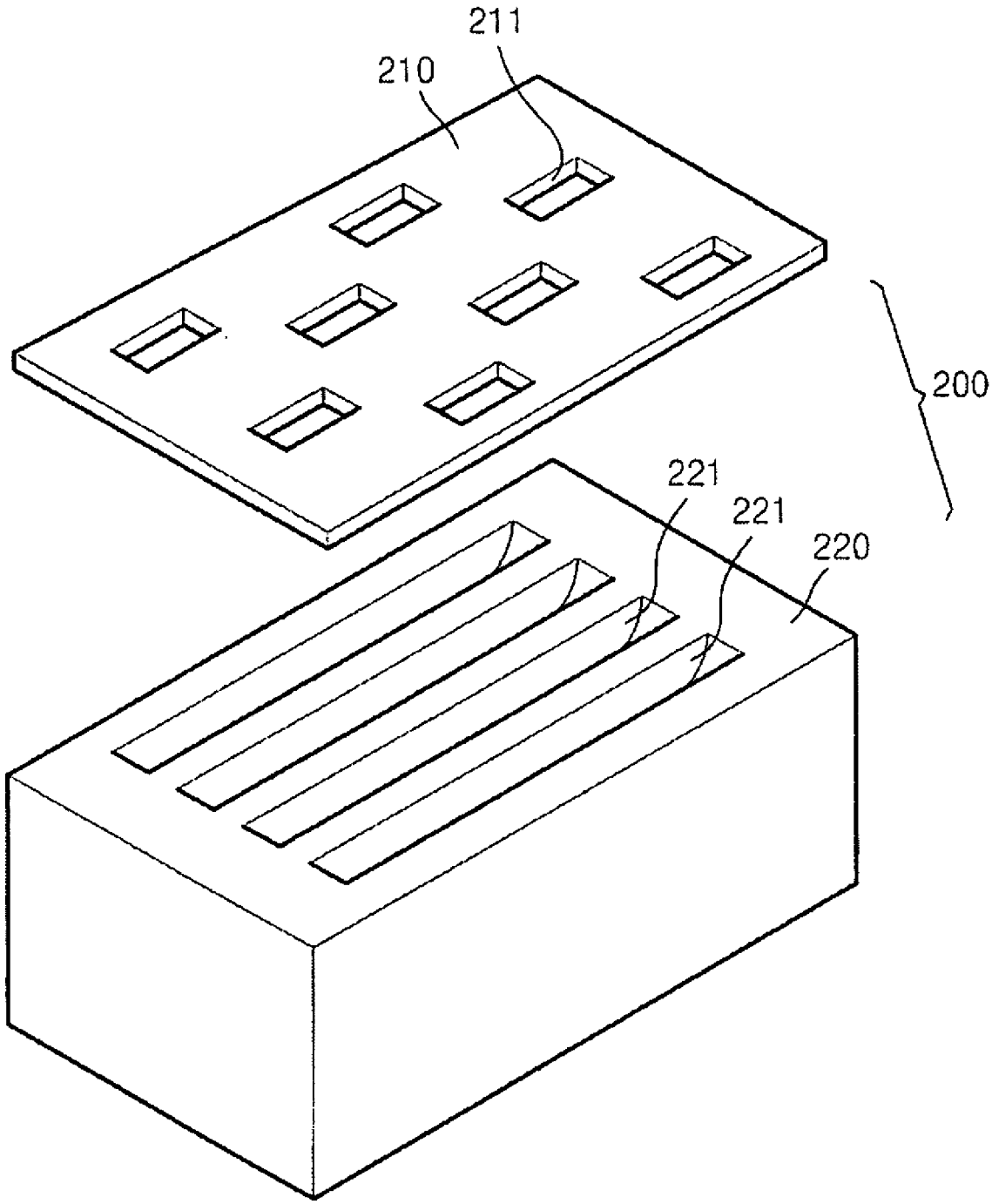
FIG. 8 is an oblique view of the base header shown in FIG. 1.

Referring to FIG. 1, the base header 200 is attached to a bottom surface of the inkjet head 100. FIG. 8 is an oblique view of the base header 200 shown in FIG. 1.

Referring to FIG. 8, the base header 200 includes a body 220 and a base plate 210 that is disposed on the body 220, and which is to be attached to the rear surface of the substrate 110. The ink supply slots 211 are arranged on the base plate 210 in a manner corresponding to the respective via holes 111'. That is, when the base plate 210 is attached to the rear surface of the substrate 110, the ink supply slots 211 formed in the base plate 210 are correspondingly coincide with the via holes 111' formed in the rear surface of the substrate 110. The body 220 may further include ink supply paths 221 formed therein to correspond to one or more respective ink supply slots 210. Thus, the ink supply paths 221 are in fluid communication with the respective corresponding to the ink feed holes 111 through the ink supply slots 211 and the via holes 111'. While for an illustrative purpose, FIG. 8 shows four ink supply paths 221 formed corresponding to four ink feed holes 111, the number and the shapes of the ink supply paths 221 may vary according to alternative embodiments.

In an ink ejecting device, according to one or more of the embodiments described above, ink of a predetermined color from an ink cartridge (not shown) may be supplied to a ink feed hole 111 via a ink supply path 221, the ink supply slots 211 and the via holes 111'.

Hereinafter, a method of manufacturing an ink ejecting device according to an embodiment will be described. FIGS. 9 through 14 are diagrams for describing a method of manufacturing the inkjet head 100 according to an embodiment. For the sake of brevity, a case where one ink feed hole is formed in a substrate will be described as an illustrative example.

Figure 9:
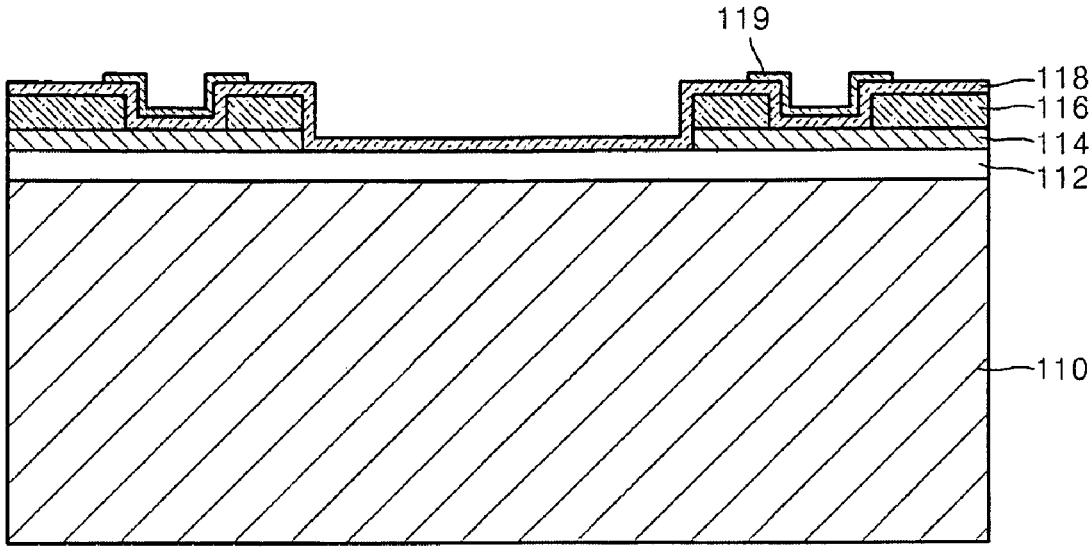
FIGS. 9 through 14 illustrate a method of manufacturing an inkjet head according to an embodiment of the present disclosure.

Referring to FIG. 9, the substrate 110 is provided. The substrate 110 may be a silicon substrate, for example. Then the insulation layer 112 having a predetermined thickness is formed on the substrate 110. The insulation layer 112 is for heat and electrical insulation between the substrate 110 and the heaters 114 as will be further described below, and may be formed of, for example, silicon oxide. Then, the heaters 114 for generating ink bubbles by heating the ink are formed on the insulation layer 112. The heaters 114 may be formed by depositing resistive heating material, such as tantalum-aluminium alloy, tantalum nitride, titanium nitride, tungsten silicide, or the like, on the insulation layer 112, and by patterning the deposited resistance heating elements as shown. Then, the electrodes 116 for applying electric current to the heaters 114 are formed on the heaters 114. The electrodes 116 may be formed by depositing metals exhibiting sufficient electrical conductivity, such as aluminium (Al), aluminium alloy, gold (Au), silver (Ag), or the like, on the heaters 114 and patterning the deposited metals. Then, the passivation layer 118 may be formed on the insulation layer 112 to cover the heaters 114 and the electrodes 116 and prevent the heaters 114 and the electrodes 116 from being oxidized and/or corroded by ink that may otherwise come into contact with the heaters 114 and the electrodes 116. The passivation layer 118 may be formed of silicon oxide or silicon nitride, for example. Furthermore, anti-cavitation layers 119 may further be formed on the passivation layer 118. The anti-cavitation layers 119 are layers for protecting the heaters 114 from a cavitation force generated when bubbles expand and burst. The anti-cavitation layer 119 may be formed by depositing a material, e.g., tantalum, on the passivation layer 118 and patterning the deposited material.

Figure 10:
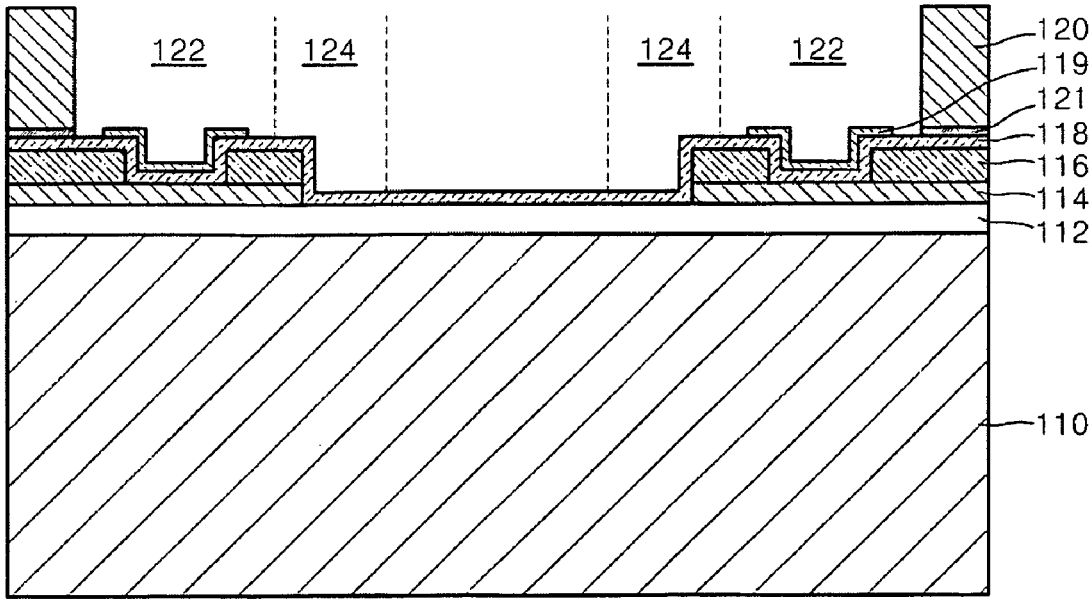

Referring to FIG. 10, a chamber layer 120 is stacked on the passivation layer 118. The chamber layer 120 may be formed by forming a photo-resist material, e.g., photosensitive polymer, on the passivation layer 118 to a predetermined thickness, and patterning the material to define the ink chambers 122 in the chamber layer 120, above the heaters 114, for containment of ink to be ejected. A plurality of restrictors 124, which define the ink flow paths into the ink chambers 122 from the ink feed hole 111 (See, e.g., FIGS. 3 and 14), may further be formed in the chamber layer 120. According to an embodiment, a glue layer 121 for increasing adhesiveness between the passivation layer 118 and the chamber layer 120 may be formed on the passivation layer 118 prior to the formation of the chamber layer 120. According to an embodiment, after either the passivation layer 118 or the glue layer 121 is formed, one or more trenches (not shown) may additionally be formed by sequentially etching the passivation layer 118 and the insulation layer 112 above the location where the ink feed hole 111 is to be formed as will be further described below.

Figure 11:
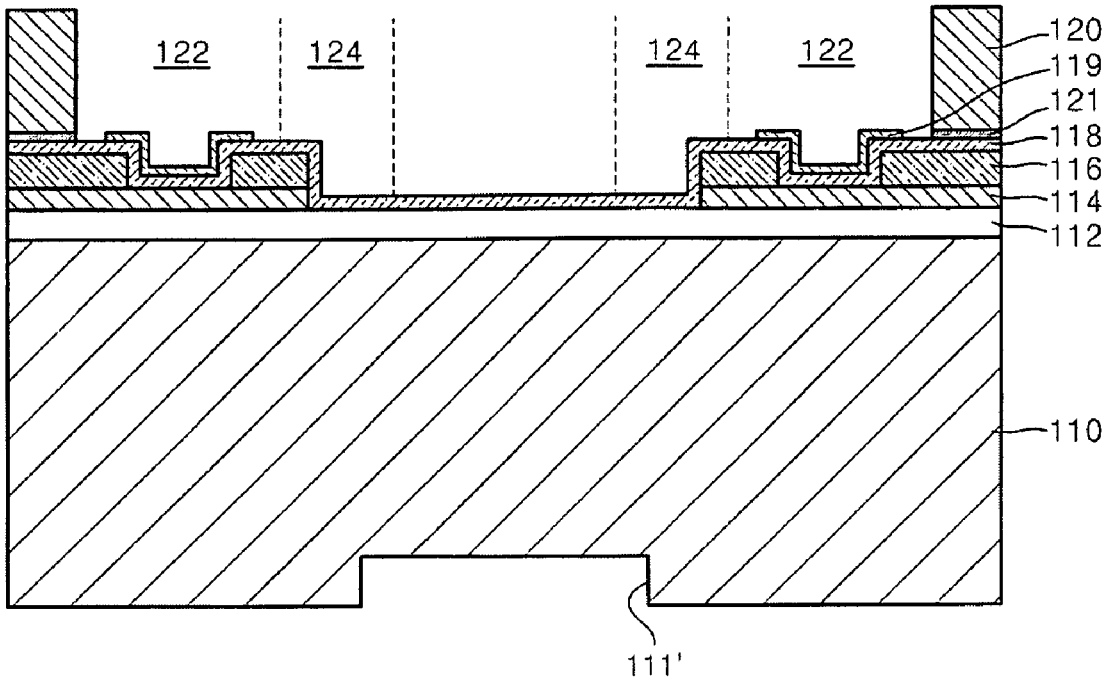

Referring to FIG. 11, the via hole 111' is formed in the rear surface of the substrate 110 in a predetermined depth. Here, the via hole 111' may be formed on the bottom surface of the substrate below the location where the ink feed hole 111 is to be formed. The via hole 111' may be formed by providing an etching mask (not shown), on which a predetermined etching pattern is formed, on the rear surface of the substrate 110 and etching a portion of the substrate 110 exposed through the etching pattern to a predetermined depth. According to an embodiment, the width of the via hole 111' may be greater than the width of the ink feed hole 111. However, other alternative embodiments are also possible where the width of the via holes 111' may equal or may be smaller than the width of the ink feed hole 111. The remaining bottom portion of the substrate 110 between the via holes 111' may thus form one or more support beams 110*a* (e.g., as shown in FIG. 5).

Figure 12:
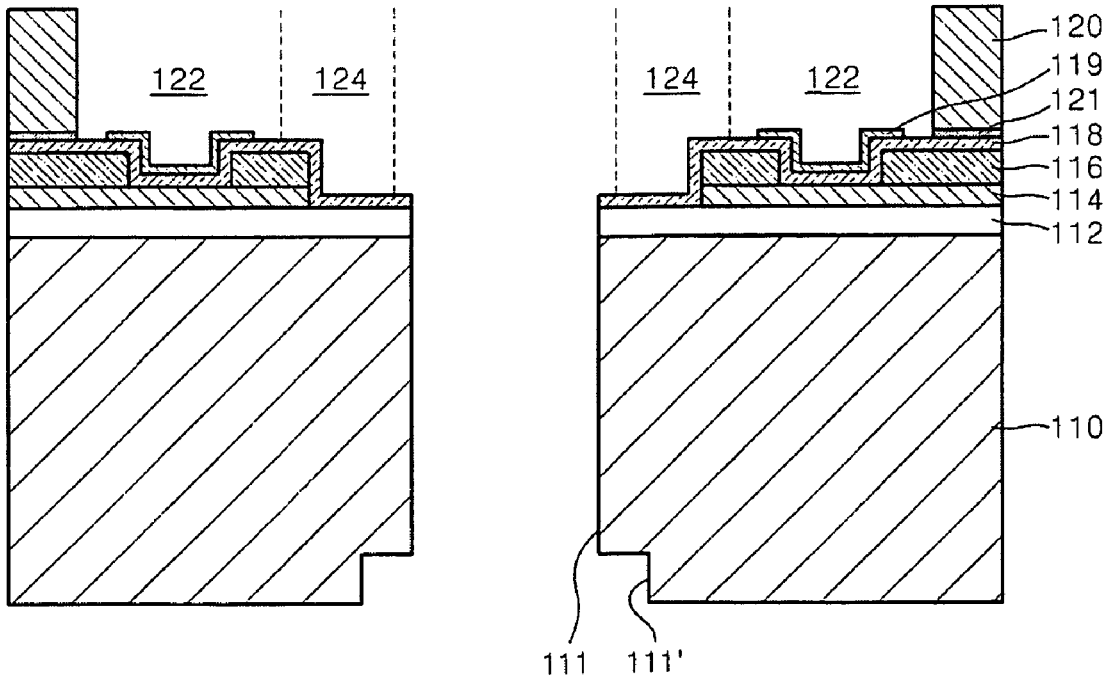

Referring to FIG. 12, the ink feed hole 111 is formed in the substrate 110 above the via hole 111' to connect to the via hole 111'. The ink feed hole 111 may be formed by, e.g., dry-etching the top surface of the substrate 110 until the via hole 111' is exposed.

Figure 13:
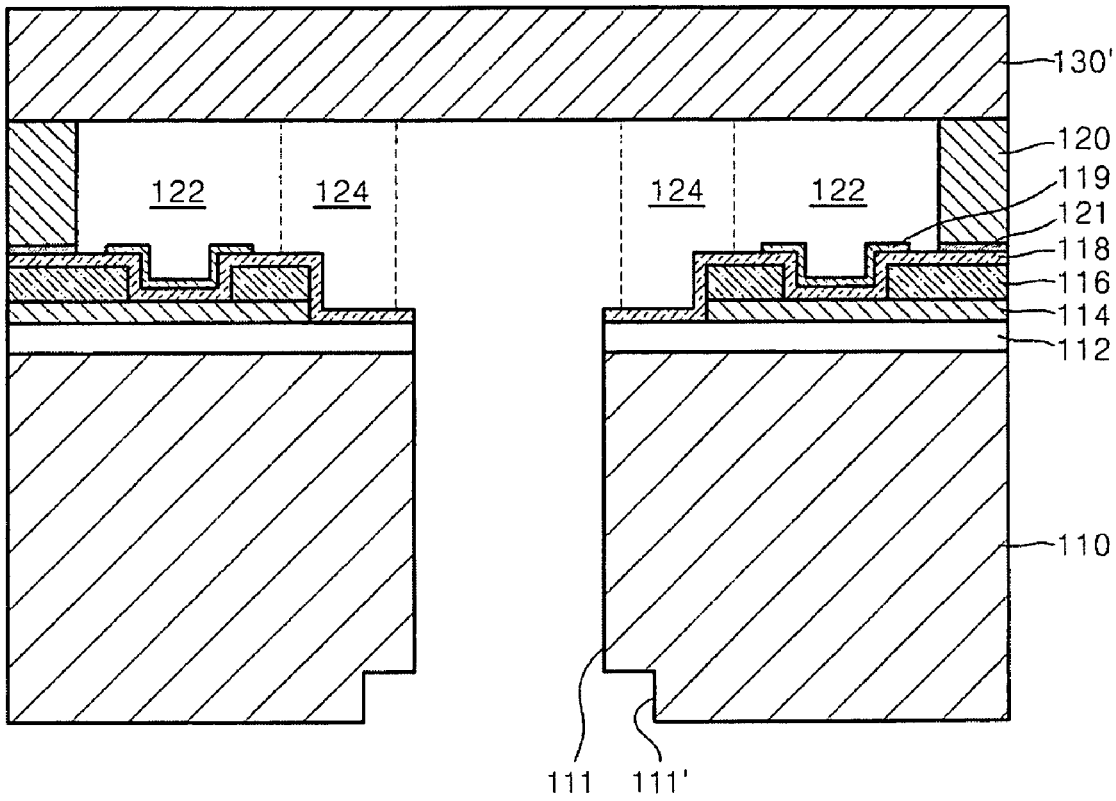
Figure 14:
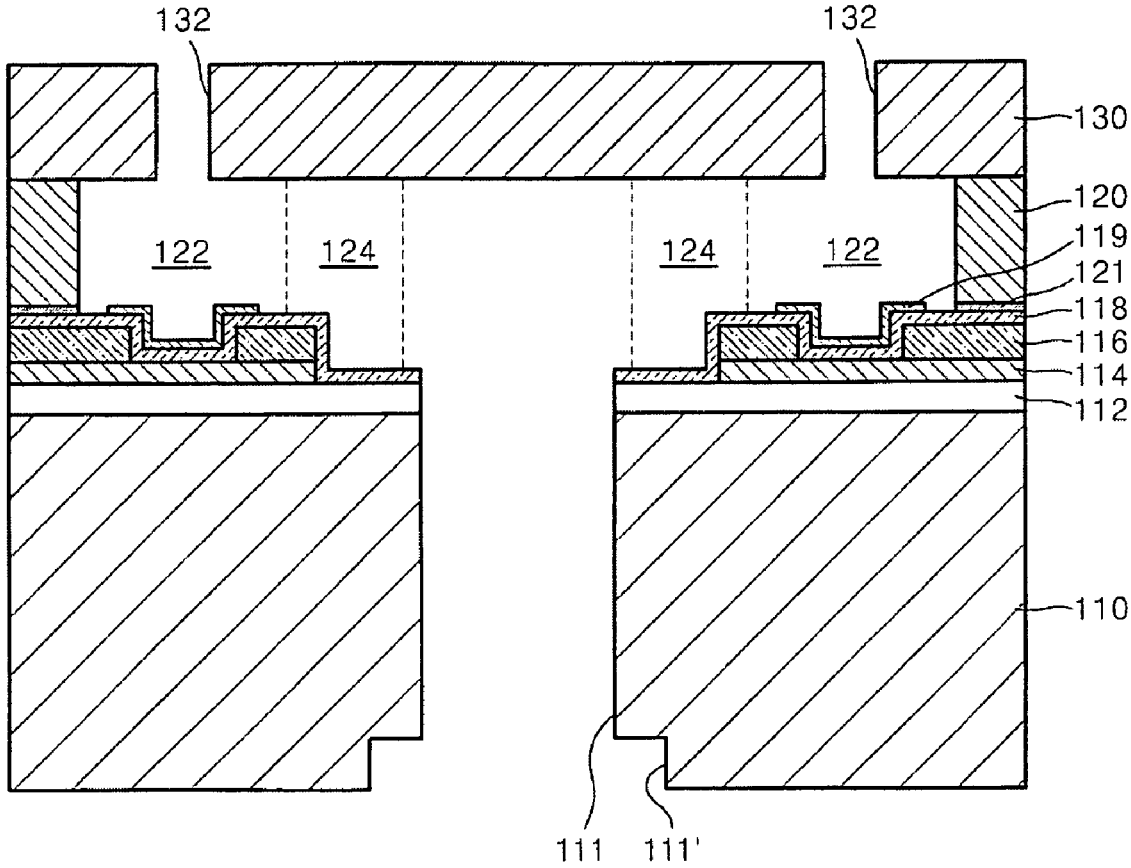

Referring to FIG. 13, a nozzle material layer 130' is formed on the chamber layer 120. The nozzle material layer 130' may be formed by laminating a predetermined photosensitive dry film on the chamber layer 120. Then, referring to FIG. 14, the nozzle layer 130 including the nozzles 132 is formed by patterning the nozzle material layer 130' using a photolithography method.

Then, the base header 200 (shown in FIG. 1) to be attached to the inkjet head 100 manufactured as described above is provided. The base header 200 may be manufactured by combining the base plate 210, in which the ink supply slots 211 are formed, and the body 220, in which an ink supply path 221 is formed, as, e.g., shown in FIG. 8. The ink supply slots 211 may be formed in a configuration that correspond to the via holes 111' formed in the rear surface of the substrate 110. The ink supply slots 211 may be formed to connect with the ink supply path 221.

Then, the base header 200 is attached to the inkjet head 100 with an adhesive, thus completing the fabrication of an ink ejecting device according to an embodiment. The base plate 210 of the base header 220 is attached to the rear surface of the substrate 110 of the inkjet head 100 in such a manner the ink supply slots 211 are correspondingly connected to via holes 111'.

While the present disclosure has been particularly shown and described with reference to exemplary embodiments thereof, it will be understood by those of ordinary skill in the art that various changes in form and details may be made therein without departing from the spirit and scope of the present disclosure as defined by the following claims.

What is claimed is:

1. An ink ejecting device, comprising:

an inkjet head having a substrate, the inkjet head comprising:

an ink feed hole formed in the substrate;

a plurality of via holes formed in a rear surface of the substrate, each of the plurality of via holes being connected to the ink feed hole;

a chamber layer stacked on the substrate; and a nozzle layer stacked on the chamber layer; and a base header on which the inkjet head is supported, the base header comprising a plurality of ink supply slots arranged to correspond to the plurality of via holes.

2. The ink ejecting device of claim 1, wherein the base header comprises:

a base plate in which the ink supply slots are formed; and a body supporting the base plate thereon, the body including an ink supply path formed therein, the ink supply path being connected to the ink supply slots of the base plate.

3. The ink ejecting device of claim 2, wherein the base plate is attached to the rear surface of the substrate such that each of the plurality of ink supply slots is correspondingly connected to respective associated one of the plurality of via holes.

4. The ink ejecting device of claim 1, wherein a portion of the rear surface of the substrate between the via holes forms at least one support beam.

5. The ink ejecting device of claim 1, wherein each of the plurality via holes is wider than the ink feed hole.

6. The ink ejecting device of claim 1, wherein the chamber layer includes one or more ink chambers formed therein for holding ink supplied by the ink feed hole, and Wherein the nozzle layer includes one or more of nozzles formed therein, through which ink is ejected from the one or more ink chambers.

7. The ink ejecting device of claim 6, wherein the ink chambers are formed along both sides of the ink feed hole, and wherein the nozzles are formed above the ink chambers.

8. The ink ejecting device of claim 1, further comprising:

an insulation layer formed on the substrate;

a plurality of heaters and a plurality of electrodes sequentially formed on the insulation layer; and a passivation layer formed over, and covering, the heaters and the electrodes.

9. The ink ejecting device of claim 8, further comprising an anti-cavitation layer formed on the passivation layer.

* * * * *

UNITED STATES PATENT AND TRADEMARK OFFICE

CERTIFICATE OF CORRECTION

PATENT NO. : 8,109,609 B2
APPLICATION NO. : 12/416954
DATED : February 7, 2012
INVENTOR(S) : Dong-Sik Shim et al.

It is certified that error appears in the above-identified patent and that said Letters Patent is hereby corrected as shown below:

First Page, Column 2 (Abstract), Line 6, Delete "therethtough," and insert -- therethrough, --, therefor.

Column 8, Line 32, In Claim 6, Delete "Wherein" and insert -- wherein --, therefor.

Signed and Sealed this
Second Day of October, 2012

David J. Kappos

David J. Kappos
*Director of the United States Patent and Trademark Office*